United States Patent [19]

Weits et al.

[11] 4,257,526

[45] Mar. 24, 1981

[54] BOTTLE CLOSURE AND FINISH

[75] Inventors: Ferdinand Weits, Arvada; Ronald A. Pearce, Lakewood; Norman G. Pennington, Arvada, all of Colo.

[73] Assignee: Coors Container Company, Golden, Colo.

[21] Appl. No.: 935,738

[22] Filed: Aug. 21, 1978

[51] Int. Cl.[3] ..... B65D 41/06; B65D 41/36

[52] U.S. Cl. ..... 215/332; 215/318; 215/320; 215/321; 215/331

[58] Field of Search ..... 215/318, 320, 321, , 215/331, 332

[56] References Cited

U.S. PATENT DOCUMENTS

| | | | |
|---|---|---|---|
| 942,141 | 12/1909 | Hoffman | 215/332 |
| 3,344,942 | 10/1967 | Hedgewick | 215/332 |
| 3,410,460 | 11/1968 | Musher | 215/332 |
| 3,927,783 | 12/1975 | Bogert | 215/332 |
| 4,057,160 | 11/1977 | Victor | 215/318 |

FOREIGN PATENT DOCUMENTS

| | | | |
|---|---|---|---|
| 833599 | 2/1952 | Fed. Rep. of Germany | 215/332 |
| 601404 | 3/1926 | France | 215/332 |
| 680171 | 4/1930 | France | 215/332 |
| 1049059 | 12/1953 | France | 215/332 |
| 442145 | 11/1948 | Italy | 215/332 |
| 16901 | of 1896 | United Kingdom | 215/332 |
| 235431 | 6/1925 | United Kingdom | 215/332 |
| 318213 | 11/1929 | United Kingdom | 215/332 |
| 345385 | 3/1931 | United Kingdom | 215/332 |

*Primary Examiner*—George T. Hall
*Attorney, Agent, or Firm*—Kyle W. Rost

[57] ABSTRACT

A plastic closure having inner pressure sealing skirt and outer finish engaging skirt has a plurality of fingers evenly spaced around the inner side of the outer skirt. The corresponding finish has a like plurality of indentations evenly spaced around its circumference for engagement by the fingers when the cap is applied. The indentations may be in the form of recesses spaced from the bottle mouth, having a horizontal lip at the top edge, and having a side wall smoothly merging with the outer surface of the finish at the side of the recess. Alternatively, the recess may be a bayonet groove spiraling downwardly on the finish and then bending into a horizontal or upwardly spiraling groove for locking the fingers in place against pressure in the bottle. Another embodiment would employ a groove spiraling downwardly on the finish at a first depth, and then terminating in a groove portion of a second greater depth. The latter finish cooperates with a closure finger structure having a base of similar thickness to the first depth of the groove, and a boss on the base is adapted to enter the deeper groove portion and accordingly is of correspondingly greater thickness. The inner skirt of the closure forms an improved seal when its outer face is cylindrical or frusto-conical in an outward and downward flare, and the finish has a frusto-conical, downwardly converging camming surface immediately within the bottle mouth.

7 Claims, 23 Drawing Figures

BOTTLE CLOSURE AND FINISH

BACKGROUND OF THE INVENTION

1. Field of the Invention

The invention relates to bottles, jars, and more specifically to plastic closures for use on internally pressurized beverage bottles. Also disclosed is a bottle finish complimentary to the closure.

2. Description of the Prior Art

Beverage bottles have often been capped by metal "crown" clossures requiring a mechanical lifter for removal. The corresponding bottle finish employs a smooth bead at the bottle mouth and extending radially to the side thereof. The metal cap is crimped over the bead and is mechanically expanded during removal. The common structure is useful for retaining the pressure of carbonated beverages within the bottle. A major problem is that the cap cannot be reused after removal and presents a source of litter.

Other metal closures, known as "twist-off" caps, are hand twistable for removal but otherwise are quite similar to the above mentioned crown bottle caps. The corresponding bottle finish is equipped with short upwardly spiraling threads that extend for one-fourth to one-third of the circumferential distance around the bottle mouth. This type of closure is commonly used on non-returnable bottles, since the finish is far less durable than the type employing a smooth bead. The threads are easily damaged, as is the thinner bottle lip. This type of bottle is often objected to as being a source of litter.

Still other metal closures fully screw-on and off the bottles, and the finish is threaded to accomodate them. These threads also lack durability.

One of the most desirable solutions to the problems of metal closures is to construct the closure from a plastic that would allow the bottle to be resealed and would provide improved protection for the bottle finish. Many plastic closures have been proposed in the prior art, but the inherent flexibility of most plastics results in blow-off of such caps under the internal pressures generated by most carbonated soft drinks, beers and ales. To overcome this problem, plastic caps have now been made that incorporate an inner skirt that enters the bottle mouth to pressure seal the contained beverage. Other advances include an outer strengthening collar for holding the closure on the bead of the finish. Still other plastic closures have combined the features of screwing completely onto the bottle for a tight fit while employing an inner skirt for added pressure seal. In short, known plastic caps follow the design concepts of the older metal crown caps and screw-on caps, but the limitations of plastic materials have not yet allowed creating of a "twist-off" style plastic closure.

The advantages of a twist-off plastic closure include ease of use, low torque removal, reuseability, recycleability, better protection for the bottle finish, more gentle application to the bottle finish, less possibility of injuring the user's hand during removal, less possibility of injuring others if carelessly discarded, and a potential for biodegradability. Yet, another and completely unexpected advantage is that the use of plastic closures allows the creation of a completely new type of bottle finish that is far more durable than known twist-off or screw-on bottle finishes. Consequently, the twist-off feature can be applied to returnable and recycleable bottles where it was not practical to do so with metal closures. Such a new bottle finish can have a durability that compares with the bead finish used with the traditional metal crown cap.

These advantages and others reside in the invention, as described below.

SUMMARY OF THE INVENTION

A finish cylindrically surrounding the mouth of a beverage bottle has a plurality of circumferentially spaced and aligned recesses slightly below the bottle mouth. Each recess has a top, side, and, optionally, bottom surface. The top surface extends radially inwardly from the surface of the finish and terminates in the side surface, extending downwardly. In the circumferential direction, the side surface may be flat, convex, or concave, eventually merging with the original outer surface of the finish to terminate the circumferential extent of the recess. A cooperating closure is formed from a synthetic resin such as a plastic and has a base with a depending outer skirt that fits around the described finish. On the interior of the skirt are a plurality of radially inwardly extending fingers corresponding in number and position to the recesses, and each finger is engaged in a recess under the top surface thereof to hold the closure on the bottle against any internal pressure. The closure is removed by circumferential twisting whereby the recess side surface cams the fingers radially outwardly to the level of the unbroken finish, after which the closure may be lifted from the bottle without restraint by the recess top surface. Each finger may have a radially outward and downward sloping bottom surface for camming the fingers over the finish during application of the closure over the finish.

Another embodiment of the finish employs a dual angle top recess surface in the circumferential direction, whereby the closure fingers are held under a first angle when the bottle is tightly sealed, but the fingers may be twisted to a second circumferential position wherein the top surface angles upwardly toward the bottle mouth, allowing the closure to be partially twisted from the bottle mouth for release of pressure prior to final twisting of the fingers circumferentially from under the entire top surface for complete removal.

The closure may have an inner depending skirt as is known for retaining pressure, but the skirt may be cylindrical on its radially outward facing side and have a downward and radially outward curving lower edge on its radially inward facing side for greater inward facing surface area for a better seal under pressure in the bottle. To enable this closure to be applied by inserting the inner skirt into the bottle, the corresponding bottle finish radially inwardly and downwardly angled at the top inner edge surrounding the mouth.

The main object of the invention is to create a bottle finish and closure combination wherein the closure may be manufactured from a synthetic resin such as polyethylene or polypropylene, and the finish may be formed from extreme durability.

A further object is to create a plastic closure that may be removed by hand. As the interests of hand removal make crown closures impractical and the interests of durable finish make threads impractical, a new type of finish is created that relies on the flexibility of plastic closures to enable hand twisting to remove the closure through slight deformation thereof.

An important object of the invention is to improve the pressure seal of a plastic closure through redesign of the inner skirt and complimentary redesign of the finish adjacent to the bottle mouth.

DESCRIPTION OF THE PREFERRED EMBODIMENT

Figure 1:
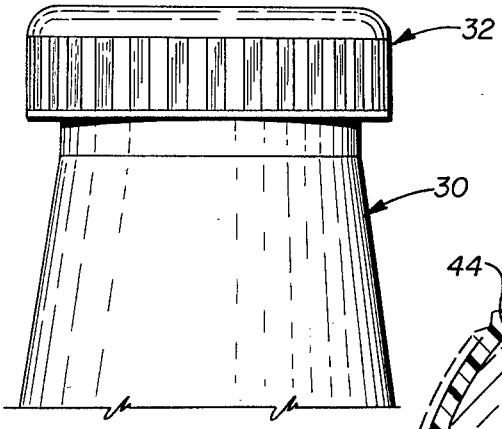
FIG. 1 is a side elevational view of a bottle neck carrying a closure.

Bottle closures and corresponding bottle finishes must cooperate to achieve an adequate seal against internal pressures, such as from a carbonated beverage, beer or ale. FIG. 1 illustrates the upper portion or neck 30 of a bottle, traditionally constructed of glass although the bottle could alternatively be of plastic or other material. The bottle neck 30 carries a closure 32 mounted at the upper extreme thereof, commonly referred to as the finish 34, FIGS. 2 and 3. The closure and the bottle finish are configured such that the finish will be highly durable and capable of being reused numerous times, and the closure will be hand removeable by twisting action. For convenience of description, the bottle and closure will be hereafter described with respect to a bottle standing vertically on its bottom with its mouth at the top thereof, and having a vertical central axis of symmetry.

The bottle finish 34 may be in the known size range for beverage bottles, which is generally from 26 mm to 42 mm outside diameter. In the customary configuration, best shown in FIG. 3, bottle neck 30 converges toward the finish at a small angle to the vertical, such as 8½ degrees. The finish is characterized by an annular inner surface 36 perpendicular to the horizontal bottle mouth. The exterior surface 38 extends vertically upwardly from the union 40 between the neck and finish for a short distance, and then curves radially outwardly at 42 and upwardly at 44, forming a bottle lip 46 that is substantially thicker than closely adjacent portions of the bottle neck or the finish. Surfaces 36 and 44 extend vertically to the upper edge of the finish, where they are connected by the smooth curve of surface 48. Lip 46 is exceptionally durable because of its thickness, and in this aspect is similar to the well known crown finish.

The finish 34 is distinguished from the crown finish by the relatively greater vertical length of thickened lip 46 as compared to known bottle beads, and in addition, the lip has a plurality of horizontally aligned indentations or recesses 50 formed therein to serve as retaining means for the associated closure 32. Each recess is bounded on its upper edge by a radially inwardly extending surface 52 joining surface 44 to the vertical surface 54, FIG. 3, of the recess. It may be noted at the left-hand side of FIG. 3 that above each recess is a remaining portion of lip 46 between surfaces 52 and 48 that resembles the durable bead found on crown closures, and below each recess may be a bead-like segment 56. However, segment 56 is not necessary and surface 54 may smoothly join surface 38 in place of the illustrated bead 56.

A representative bottle structure may have an inner diameter between surfaces 36 of 18 mm, an outer diameter between surfaces 44 of 27 mm, and height between union 40 and surface 48 of 16 mm. The maximum depth of recess 50 may be approximately 1.32 mm, and the vertical thickness of the finish above surface 52 may be approximately 4 mm.

Figure 2:
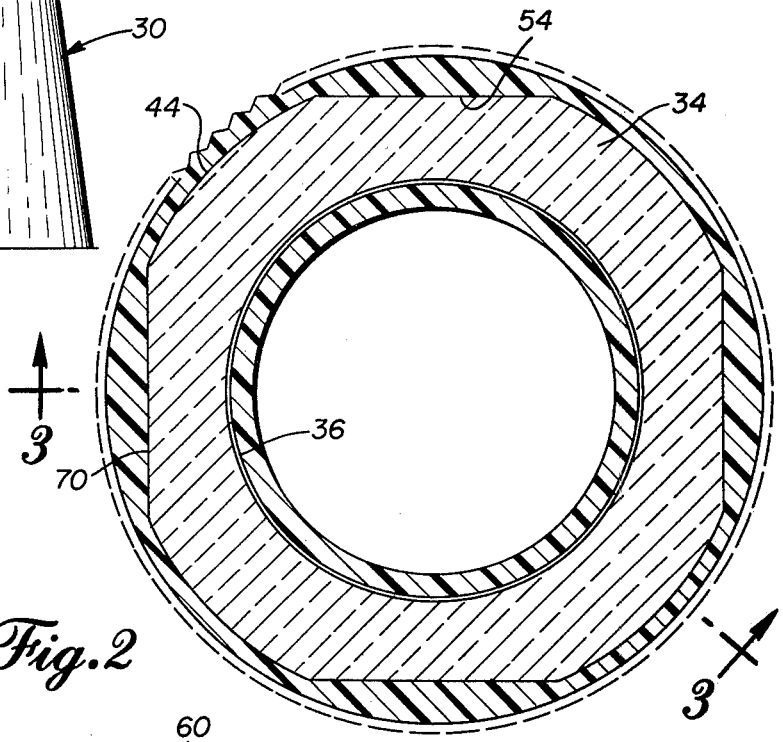
FIG. 2 is a horizontal cross-sectional view taken through the plane of line 2—2 of FIG. 3.

With reference now to FIG. 2, each surface 54 is illustrated to be flat, and four such surfaces are evenly spaced in quadrature about the circumference of the finish. In the embodiment for which dimensions are given above, each surface 54 may be viewed as the chord of an arc of between 40 and 50 degrees, preferably 46 degrees, and the four intermediate arcs of surface 44 are approximately 44 degrees. Although surfaces 54 are preferred to be flat, these surfaces may alternatively be concave or convex.

Figure 3:
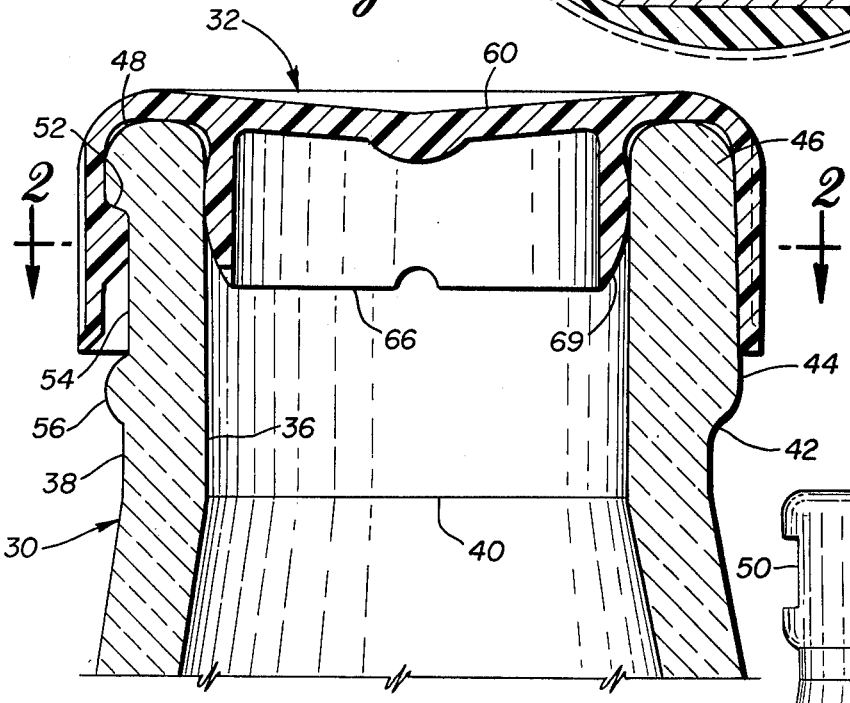
FIG. 3 is a vertical cross-sectional view taken through the plane of line 3—3 of FIG. 2.
Figure 4:
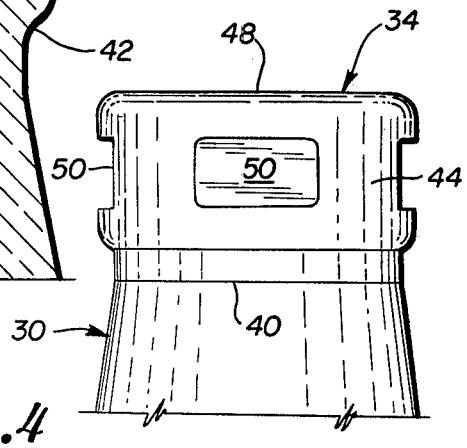
FIG. 4 is a side elevational view of the finish on a bottle neck.
Figure 5:
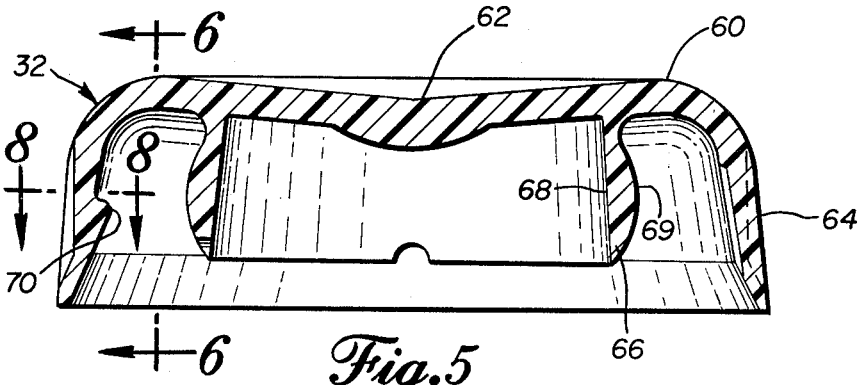
FIG. 5 is a vertical cross-sectional view similar to FIG. 3 showing the closure only.

The closure 32, FIG. 5, that cooperates with the bottle 30 is preferably constructed of a plastic, such as high or high medium density polyethylene. It is known in the prior art to use this material for closures and further, that such caps are provided with a base 60 being slightly downwardly convex in the center 62. Because such caps are more flexible than metal, a seal is employed in the form of an inner depending skirt 66 that contacts the interior of the finish. The inner skirt aids in preventing loss of pressure, since the surface area of side 68 is greater than the surface area of side 69 that is exposed to the internal pressure of the bottle, as best shown in FIG. 3.

Figure 6:
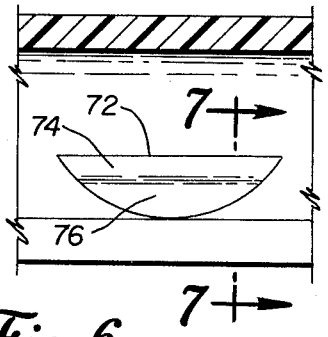
FIG. 6 is a cross-sectional view taken along the plane of line 6—6 of FIG. 5, showing a holding finger.
Figure 7:
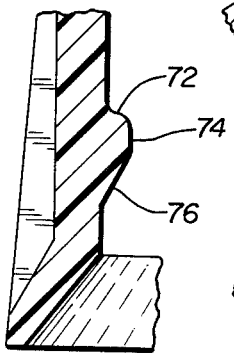
FIG. 7 is a cross-sectional view taken along the plane of line 7—7 of FIG. 6, showing a holding finger.

The invention with respect to the closure relates to the addition of holding fingers 70 to the radially inner surface of outer skirt 64. Each finger extends radially inwardly toward inner skirt 66 and is adapted to be received in one of recesses 50 in the bottle finish. As viewed in FIGS. 5–7, each finger has a substantially flat upper side 72 that projects radially inwardly from the outer skirt, for engaging the surface 52 of recess 50. It is desired that side 72 be a planar horizontal surface but, it may be necessary to be angled slightly radially inwardly and downwardly for ease of molding. Each finger may have a substantially vertical surface 74 that faces surface 54 of the recess 50, and a downward and radially outward angling surface 76 that connects the bottom of the finger to the outer skirt 64. As shown in FIG. 6, the finger may be shaped with an arcuate bottom edge; alternatively, this edge may be a straight, horizontal line. The angle of surface 76 may be about 30 degrees from vertical for the purpose of guiding the finger over the bottle finish when the closure is applied.

In a preferred version of the closure illustrated in FIG. 5, the center of base 60 is concave at an angle of approximately 5 degrees from the horizontal plane of the closure rim. Skirt 64 depends from the outer edge of the base at a right angle thereto, and inner skirt 66 is almost at a right angle to the adjacent base, for example at 89 degrees to surface 68, with the result that both skirts have an outward and downward flare. Alternatively, both skirts may depend vertically from base 60. The inward protrusion of fingers 70 from the outer skirt may be between 0.8 and 1.0 mm, and each finger may be viewed as the chord of an arc of 40 to 50 degrees, preferably 46 degrees, as measured on the inner surface of the outer skirt. Correspondingly, the curve of the inner skirt between fingers may have an arc of between 40 and 50 degrees. It will be noted that each finger may protrude for a smaller or equal distance than the depth of the corresponding preferred recess, and each finger is the chord of an arc equal or longer than that of the corresponding recess. The resultant fit of the closure on the bottle finish is quite close, but removal forces are such that hand twisting is possible. As the dimensions of the closure are adjusted to more closely correspond to the dimensions of the finish, a closer and more pressure resistant fit is achieved, but removal becomes correspondingly more difficult. The maximum outer diameter of the inner skirt in unflexed condition may be 18.75 mm, which is slightly greater than the diameter of the bottle mouth, and the minimum inner diameter of the outer skirt immediately above fingers 70 may be 26.9 mm, or the same as the corresponding diameter of the bottle finish.

Figure 8:
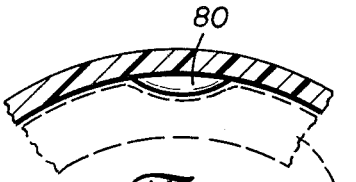
FIG. 8 is a cross-sectional view of the closure taken along the plane of line 8—8 of FIG. 5, showing a variation of the fingers.
Figure 9:
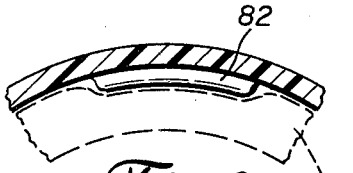
FIG. 9 is a cross-sectional view similar to FIG. 8, showing another variation of the holding fingers.

While FIG. 2 illustrates the preferred configuration of the fingers to be flat as they face the bottle finish, FIGS. 8 and 9 illustrate alternative configurations in which the fingers are convex 80 or concave 82, respectively, for engagement with similarly contoured recesses in the finish. The convex shape 80 of FIG. 8 requires relatively greater removal twisting torque, while the configuration 82 of FIG. 9 requires less removal torque.

In use, the closure of FIG. 5 may be applied to the bottle finish by a capping machine that presses the outer skirt 64 over the finish while forcing the inner skirt 66 into the bottle mouth and rotates fingers 70 into recesses 50. The flexibility and resilience of the plastic closure allow the fingers to firmly enter recesses 50 and thereby hold the closure in place against the pressure within the bottle. Since surfaces 52 of the recesses and surfaces 72 of the fingers are each parallel and circumferentially horizontally aligned, there is no tendency for pressure in the bottle to urge the cap to twist off. Bottle pressure is directly opposed by the snap fit of the fingers in the recesses. When it is desired to open the bottle, a conventional opener could be used as is known for crown closures and snap-on plastic closures, but the important feature of the present closure is that it can be hand-twisted, bringing the fingers 70 out of recesses 50 and onto intermediate areas of wall 44 on lip 46. The twisting action allows the fingers to be cammed out of the recesses with manageable force, and when the fingers are no longer held under surface 52, the closure is easily raised from the bottle mouth. The removal process causes some stretching in the outer skirt of the closure and thereafter the closure can be replaced by hand, although not with the tightness of the original seal.

Figure 10:
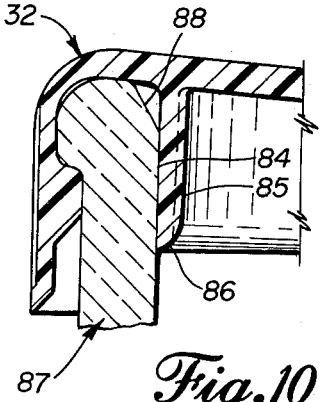
FIG. 10 is a partial vertical sectional view of a modified form of the closure and finish.

A further improvement in the closure relates to the embodiment of FIG. 10. The skirt 66 of FIG. 5 is arcuate in cross-section of its radially outer side 69, while it is flat on its radially inner side 68. This arrangement has been used in the prior art to enable the inner skirt to be successfully inserted into the bottle mouth, with the curvature of the outer side 69 acting to cam the skirt into the bottle mouth. As noted above, the pressure within the bottle tends not to escape, since surface 68 has greater area than the portion of 69 exposed to interior pressures of the bottle.

In FIG. 10, the inner skirt has outer side 84 flat in cross-section, and inner side 85 that curves radially outwardly and downwardly at 86. This skirt can be inserted into the bottle mouth through modification of the finish. Where prior art finishes employed a uniform curve as shown at surface 48, FIG. 3, the finish 87 of FIG. 10 employs a camming surface 88, better shown in FIG. 11, angled radially inwardly and downwardly at an angle between 10 degrees and 30 degrees or more from the vertical, preferably at an angle of 15 to 20 degrees. The annular frusto-conical surface formed by camming surface 88 may have a vertical height of 2.39 mm, below which the finish becomes cylindrical with vertical side 89 extending at a uniform diameter to provide a surface against which the inner skirt may seal.

Figure 11:
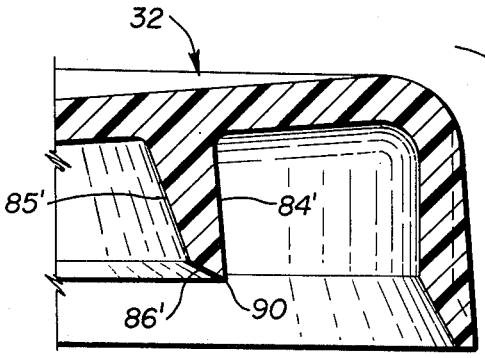
FIG. 11 is a view similar to FIG. 10 showing further modification of the finish and closure, with the closure separated from the finish for clarity.
Figure 11:
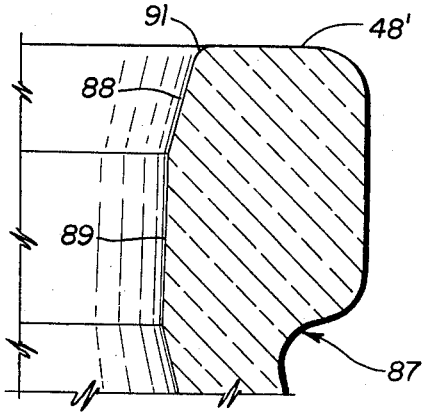

A modified form on the inner skirt is illustrated in FIG. 11 to include outer side 84' angling downwardly and radially outwardly at between 0–15 degrees from the vertical, and inner side 85' angling downwardly and outwardly at between 0–45 degrees. A preferred form of this skirt has side 84' angling at 5 degrees and side 85' angling at 20 degrees, with lower end 86' of side 85' in the form of a straight line in cross-section angling radially outwardly and downwardly at 25 degrees to the horizontal. In the preferred form, a sharp, radially outwardly protruding pointed edge 90 is formed at the union of 84' and 86' for forming an efficient seal with surface 89 of the bottle finish. In the embodiment where camming surface 88 has a vertical height of 2.39 mm, the inner skirt may have a vertical height of 3.175 mm so that the edge 90 will seal against surface 80 when the closure is in place on the finish, but the seal may be broken when the closure is raised to a sufficient distance that the edge 90 is at the level of surface 88. It is desirable that the top surface 48' of the finish of FIG. 11 be substantially flat, and the corner between 48' and 88 may have a curve 91 of radius 0.381–0.508 mm.

When a closure having the inner skirt of FIG. 10 or 11 is applied to a bottle finish, the inner surface 85 or 85' bears the entire internal bottle pressure while the outer surface 84 or 84' bears none of the pressure. Accordingly, the higher the internal pressure, the tighter the seal. At low pressures, for example 17 psi, the friction level between the inner skirt and finish is quite low and allows easy removal of the closure. The embodiment of FIG. 10 results in somewhat greater removal torques than that of FIG. 11 since a substantial portion of surface 84 is pressed against the glass, as compared to only edge 90 being so pressed in FIG. 11. In either embodiment, the addition of curve 86 or surface 86' to side 85 or 85', respectively, results in an increase in the surface area bearing the internal bottle pressure and directing this pressure to create a tight seal.

Referring now to FIGS. 12–18, a modified version of the bottle and closure allows the closure to be removed with exceptionally low removal torque. In prior embodiments, it has been disclosed that the holding fingers are cammed outwardly during the removal process, and this camming action often stretches the plastic material of the closure and correspondingly requires that the sufficient force be applied to accomplish the stretching function. Such force may be eliminated through the use of bayonet grooves in the finish and suitable fingers or lugs in the closure to engage the grooves.

Figure 12:
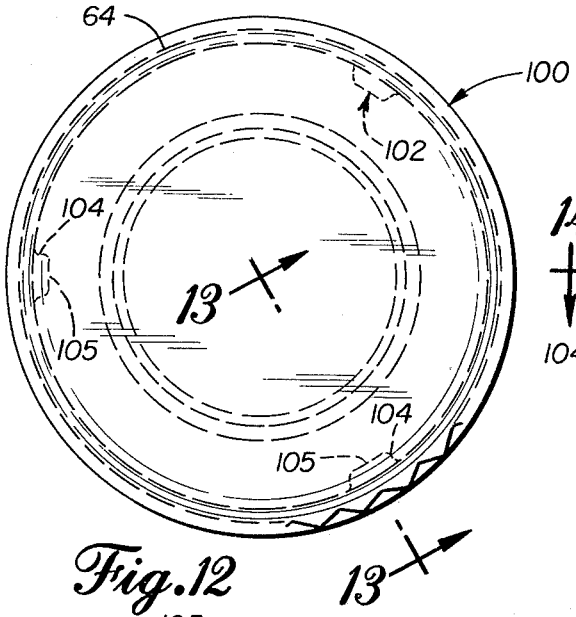
FIG. 12 is a top plan view of another embodiment of the closure showing internal structure in phantom.
Figure 13:
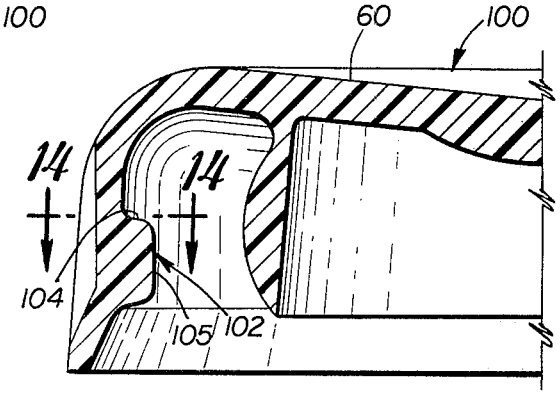
FIG. 13 is a vertical cross-sectional view of the closure taken along the plane of line 13—13 of FIG. 12.
Figure 15:
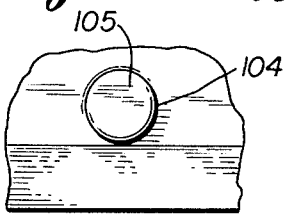
FIG. 15 is a vertical sectional view of the closure taken along the plane of line 15—15 of FIG. 14.
Figure 14:
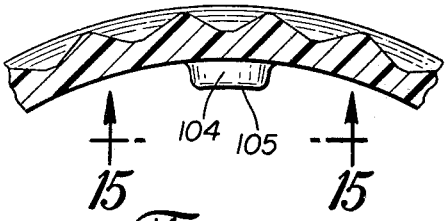
FIG. 14 is a horizontal sectional view of the closure of FIG. 13, taken along the plane of line 14—14.

The closure 100, shown in FIGS. 12–14, is of the general type previously described having an inner and outer skirt. The primary new feature relates to the shape of the holding lugs 102, adapted to be engaged in bayonet grooves in the finish. The number of lugs may be between 2 and 6, with three being preferred for finishes in the size range near 26 mm. The shape of the fingers 102 may range from a right angle cylinder, to the 45 degree frustum of a cone, to an oblique cylinder of 5 degrees. Each lug may be defined by an annular or cylindrical surface 104 and a radially inward face 105 of approximate circular shape merging with the radially inward edge of the surface 104. In the case where the lug is a right cylinder, surface 104 is the wall of the cylinder and the axis of the cylinder is normal to the outer skirt, as viewed in FIG. 13. In the case wherein the lug is frusto-conical, surface 104 converges toward surface 105 at a preferred angle of 15 degrees to the axis of the frustum, which again is normal to the outer skirt. In the case of an oblique cylinder, the axis of the lug may angle upwardly toward the base of the closure at an angle of, for example, five degrees; however, surface 105 preferably would remain approximately vertical or parrallel to the outer skirt.

In the preferred embodiment, the lug is a fifteen degree frustum and has an average diameter between 2.4 and 2.6 mm. The lug extends radially inwardly from the outer skirt for a distance of between 0.8 and 0.9 mm.

Figure 16:
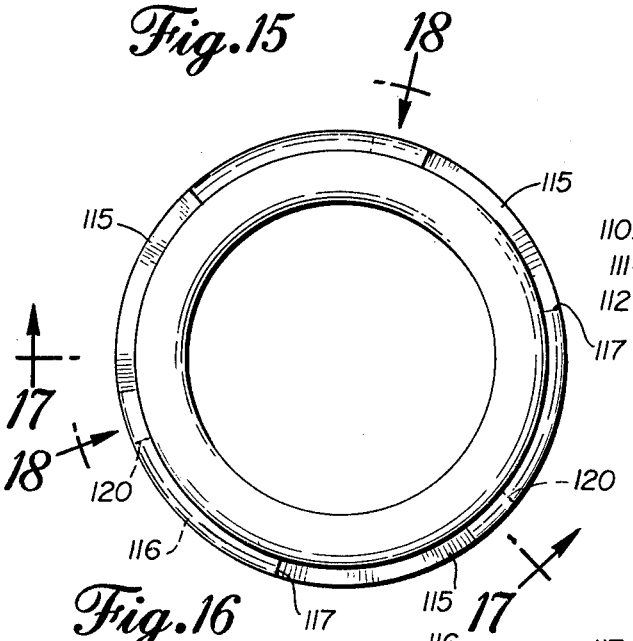
FIG. 16 is a top plan view of a modified form of the finish, showing the path of bayonet grooves in phantom.
Figure 17:
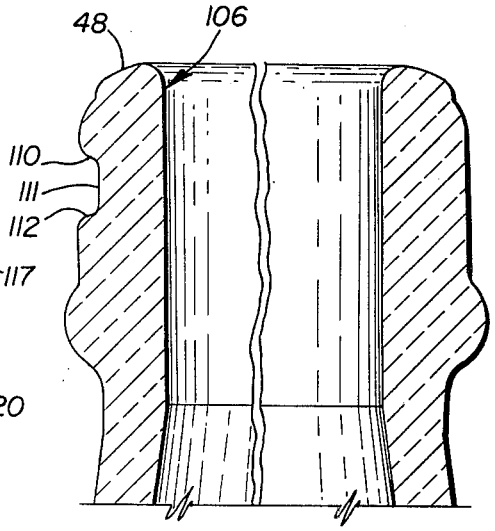
FIG. 17 is a vertical cross-sectional view of the finish of FIG. 16, taken along the plane of line 17—17.
Figure 18:
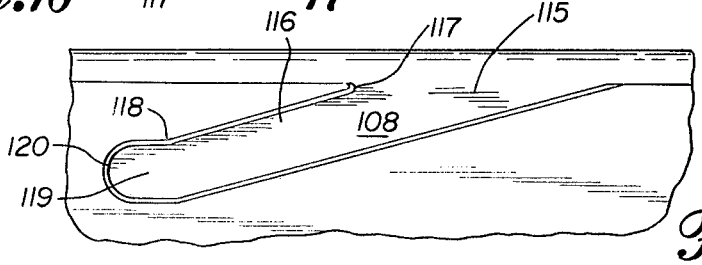
FIG. 18 is a side view of the finish of FIG. 16 taken along the arc of line 18—18, showing one bayonet groove.

The corresponding bottle finish 106 for closure 100 is illustrated in FIGS. 16–18 to have a plurality of bayonet grooves corresponding in number to the lugs 102. Each bayonet groove angles downwardly and circumferentially at a given angle, and then changes angle to lock the closure in place. The finish of FIG. 17 has a curved top surface 48 and outer surface 44, interrupted by the bayonet grooves 108 having a lug engaging upper face 110, depending vertical face 111, and lower face 112. Each groove has a preferred depth from 0.8–1.5 mm between surface 44 and face 111, and face 110 has an engagement angle of between zero and 45 degrees upwardly and outwardly from the horizontal, with 5 to 15 degrees being preferred. Surface 112 may have a similar angle downwardly and outwardly.

In the case where there are three evenly spaced bayonet grooves as shown in FIG. 16, each groove will have a mouth 115 covering an arc of approximately 55 degrees at its upper end nearest surface 48. Each groove has a first portion 116 that spirals circumferentially and downwardly, preferably in the clockwise direction as viewed in FIG. 16, along an angle of between 5 and 45 degrees from horizontal, with fifteen degrees being the preferred angle, through an arc of approximately 35 degrees as measured from the upper end 117 of upper face 110, FIG. 18. The cam angle then changes at point 118 to horizontal or to a reverse upward angle, and the groove extends for a second portion 119 for a sufficient arc, for example 15 degrees, to assure that the lug 102 will have its center point past point 118 when the lug is completely twisted in the groove and abuts end curve 120.

In use, the closure 100 is applied to the finish 106 by twisting the closure with the lugs 102 entering the grooves and bottoming against end surface 120 of the groove. A number of torque limited capping heads are known that are suited for applying this type of closure. Two of these capping heads are Pneumacap capping head manufactured by Pneumatic Scale Corporation, and Zalkin capping head manufactured by Fowler Products Company. Either of these capping heads would operate to release the closure 100 from rotational motion when the lugs 102 strike surface 120.

When the closure has been applied to the finish, the inner skirt of any of the described embodiments will have created a seal with the interior of the finish. Removal of the closure may be accomplished by hand twisting at exceptionally low torques, such as from below 5 to 8 inch-pounds. As the lugs are twisted through groove portion 119 and then through portion 116, the inner skirt will be raised relative to the bottle finish and the pressure seal will be broken allowing the closure to vent while the lugs remain engaged under surface 110, preventing blow-off of the closure during removal.

Figure 19:
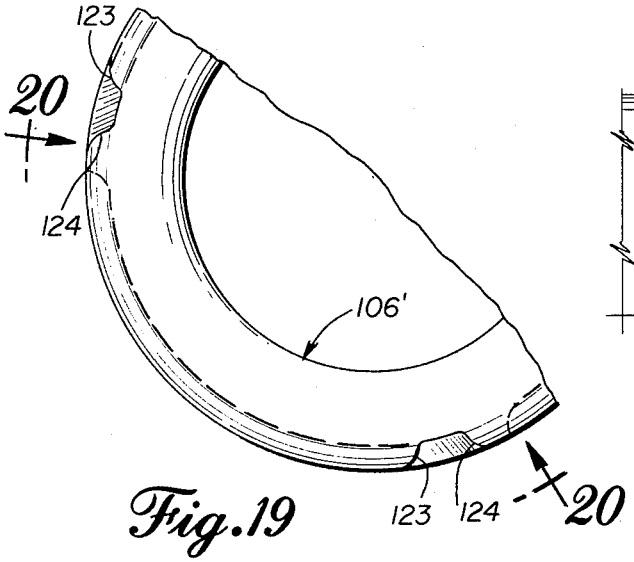
FIG. 19 is a partial top plan view of a modified form of the finish.
Figure 20:
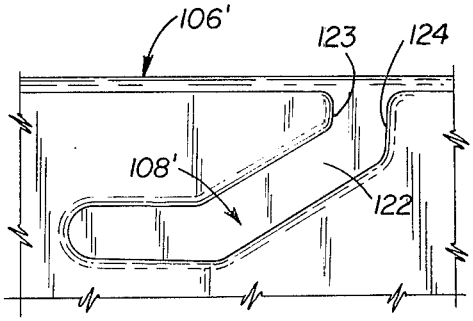
FIG. 20 is a side elevational view of the embodiment of FIG. 19, showing a bayonet groove along arc 20—20.

A slightly modified embodiment of the finish 106 is illustrated in FIGS. 19 and 20, wherein finish 106' has bayonet grooves 108' with an additional groove portion 112 running vertically with respect to the bottle mouth. Comparison of FIGS. 18 and 20 reveals that the relatively sharp corner at point 117, FIG. 18, has been eliminated and replaced with a smoother side 123 that is less suspectible to damage in bottle handling and offers a more comfortable surface when the finish is handled. Side 123 is smoothly connected to upper face 110, and the opposite edge of portion 122 is bounded by side 124, which is smoothly connected to lower edge 112. An appropriate vertical height for groove portion 122, as viewed in FIG. 20, is between 1.5 and 1.6 mm. The previously described closure 100 is easily adapted for use with finish 106' through vertical lengthening of outer skirt 64 between base 60 and each lug.

Figure 21:
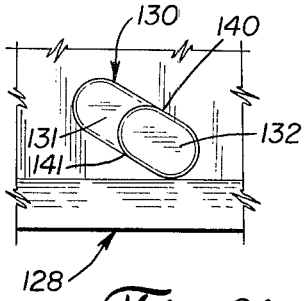
FIG. 21 is a partial vertical sectional view of a closure similar to FIG. 15, showing a further modified holding finger.
Figure 22:
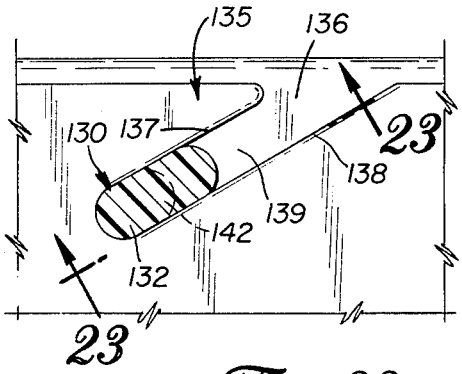
FIG. 22 is a partial side elevational view of the finish similar to FIG. 18, showing a spiral groove.
Figure 23:
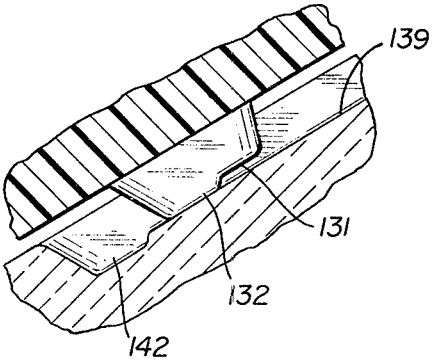
FIG. 23 is a cross-sectional view of the embodiment of FIG. 22, taken along the plane of line 23—23.

With reference now to FIGS. 21–23, the closure 128 is similar to closure 100 with the exception that the holding finger 102 has been replaced by an obliquely oriented oval finger or slug 130, as viewed in FIG. 21. Finger 130 projects radially inwardly from the outer skirt of the closure to a first step or level 131, which may have a thickness of approximately 0.85 mm, and at the lower end of the finger as viewed in FIG. 21 the finger may have a boss or second step 132 increasing the thickness of the finger by between 0.05 and 0.10 mm. The oval finger 130 has its major axis slanted at angle conforming to the cam angle of a spiral groove in the associated finish 135, which angle may be between three and forty five degrees, with seven degrees being the preferred cam angle. Any necessary number of lugs 130 may be employed, with between two and six anticipated to adequately retain the closure on finishes of between 26 and 42 mm outer diameter.

In bottle finish 135, spiral groove 136 extends circumferentially and downwardly through an arc preferably of 100 degrees or less at a cam angle as stated above. The upper surface 137 of the groove and the lower surface 138 are beveled toward the floor 139 of the groove at an angle conforming to the bevel of sides 140 and 141, respectively, of the finger 130, which may be between zero and forty five degrees. Whereas the bayonet groove in the previously described embodiment employed a change in cam angle to lock the closure in place, the present finish requires only a single cam angle with a radially inwardly extending dimple 142 at the terminal end of the groove. This dimple is shaped in complimentary fashion to boss 132 and is adapted to receive the boss when the closure has been twisted into spiral groove 136. Accordingly, the dimple has a depth radially inwardly of groove floor 139 of between 0.05 and 0.10 mm corresponding to the height of boss 132. The depth of the groove to floor 139 may be approximately 0.085 mm, which is similar to the thickness of finger 130 to level 131, and the closure inner diameter at the outer skirt is such that finger 130 would be snugly engaged in groove 136 against floor 139 without the presence of boss 132. Thus, when the closure is applied, boss 132 initially rides along floor 139 with considerable pressure, but when the closure is fully applied, the boss nests in dimple 142 and the finger 130 remains snugly within groove 136.

The presence of boss 132 in dimple 142 serves the same purpose as the change of cam angle in the bayonet groove, in that the closure is retained on the finish against any tendency to twist out of the groove due to vibrations or internal bottle pressures. Removal is accomplished by hand twisting wherein the boss is cammed onto groove floor 139, slightly stretching the outer skirt of the closure, after which the closure is twisted until the lug has been removed from the groove. While the lug is still retained under groove surface 137, the closure will be sufficiently raised from the bottle mouth that the inner skirt will break its seal and release any internal bottle pressure.

We claim:

1. An improved beverage bottle finish and pressure sealing closure thereof, wherein the beverage bottle finish is of the kind having a cylindrical shape with an open mouth at the upper axial end thereof, and the closure is of the type having a circular base adapted to fit over the bottle mouth, a first depending skirt fitting around the exterior surface of the finish, and means for sealing pressure in the bottle, wherein the improvement comprises: said closure being of a synthetic resin material, having a plurality of circumferentially spaced, integrally formed, fingers on the radially inner surface of the first skirt, wherein said fingers are at substantially equal axial height on the first skirt and are non-overlapping circumferentially, and wherein the pressure sealing means comprises a second skirt depending from the circular base inside the radius of the first skirt and having an outer pressure sealing face contacting said finish near the inner side of the open mouth; said finish having a like plurality of circumferentially evenly spaced indentations in the radially exterior surface thereof, each of said indentations comprising a bayonet groove having an upward opening near the plane of the bottle mouth, said finish further having a first groove portion spiraling circumferentially in a given first direction and downwardly from said opening at a first predetermined angle below the plane of the bottle mouth for guiding and retaining said fingers for movement out of the bayonet groove and through said opening during disengagement of the closure from the finish by twisting in a second and opposite direction; and the finish also having a second groove portion continuously connected to the lower end of said first groove portion and extending circumferentially and angling non-downwardly in the same direction for a sufficient distance to receive in excess of one-half of one of said fingers therein, said second groove portion having a terminal axially extending wall for preventing twisting of said finger past the position of the wall; and wherein said fingers, second skirt, and first groove portion are configured such that during disengagement of the closure from the finish said pressure sealing face ceases pressure sealing contact with the finish while said fingers are in said first groove portion and before the fingers are axially aligned with said opening.

2. The finish and closure of claim 1, wherein said finger comprises a right angle cylinder having its axis substantially perpendicular to said outer skirt.

3. The finish and closure of claim 1, wherein said finger comprises a frustum having its side converging radially inwardly from said outer skirt relative to the axis of the frustum.

4. The finish and closure of claim 1, wherein said finger is an oblique cylinder having its axis angling radially inwardly and upwardly from said outer skirt.

5. The finish and closure of claim 1, wherein said first groove portion is bounded along its upper edge by a surface angling radially outwardly and axially upwardly at an engagement angle of between zero and forty-five degrees.

6. The finish and closure of claim 1, wherein said first predetermined angle is approximately between five and forty-five degrees.

7. The finish and closure of claim 1, wherein said bayonet groove further comprises an axially extending groove portion depending immediately from said opening and connected to said first groove portion.

* * * * *